United States Patent [19]

Stadelmaier et al.

[11] Patent Number: 4,849,035

[45] Date of Patent: Jul. 18, 1989

[54] RARE EARTH, IRON CARBON PERMANENT MAGNET ALLOYS AND METHOD FOR PRODUCING THE SAME

[75] Inventors: Hans H. Stadelmaier; Nen-Chin Liu, both of Raleigh, N.C.

[73] Assignee: Crucible Materials Corporation, Pittsburgh, Pa.

[21] Appl. No.: 191,964

[22] Filed: May 9, 1988

Related U.S. Application Data

[62] Division of Ser. No. 83,808, Aug. 11, 1987.

[51] Int. Cl.[4] ..... H01F 1/02

[52] U.S. Cl. ..... 148/101; 148/301; 148/302; 420/83; 420/121; 420/9; 420/13; 420/14

[58] Field of Search ..... 148/301, 302, 101, 102, 148/103, 104, 105; 420/9, 13, 14, 83, 121

[56] References Cited

FOREIGN PATENT DOCUMENTS

| | | | |
|---|---|---|---|
| 0124655 | 11/1984 | European Pat. Off. | 148/301 |
| 60-144907 | 7/1985 | Japan | 148/302 |
| 60-144908 | 7/1985 | Japan | 148/302 |
| 60-144909 | 7/1985 | Japan | 148/302 |
| 60-204862 | 10/1985 | Japan | 148/301 |
| 60-254707 | 12/1985 | Japan | 148/302 |
| 60-254708 | 12/1985 | Japan | 148/302 |
| 61-10209 | 1/1986 | Japan | 148/301 |
| 61-42101 | 2/1986 | Japan | 148/301 |
| 61-51901 | 3/1986 | Japan | 148/302 |
| 61-80805 | 4/1986 | Japan | 148/301 |

*Primary Examiner*—John P. Sheehan

*Attorney, Agent, or Firm*—Finnegan, Henderson, Farabow, Garrett & Dunner

[57] ABSTRACT

A permanent magnet alloy having at least one light rare earth element, iron and carbon. The alloy has a cellular microstructure of at least two solid phases with a $Fe_{14}R_2C_1$ magnetically hard, tetragonal major phase surrounded by at least one minor phase. The light rare earth element may be Pr or Nd. At least one heavy rare earth element, such as Dy, may be used. Boron may be included in the alloy. The alloy is produced by casting and heating to form the $Fe_{14}R_2$ $(C,B)_1$ magnetically hard, tetragonal major phase.

20 Claims, No Drawings

RARE EARTH, IRON CARBON PERMANENT MAGNET ALLOYS AND METHOD FOR PRODUCING THE SAME

This is a division of application Ser. No. 083,808, filed Aug. 11, 1987.

BACKGROUND OF THE INVENTION

The present invention relates to permanent magnet alloys, and a method for producing the same, which alloys are used in the production of permanent magnets.

Permanent magnet alloys of a light rare earth element, such as neodymium, with iron or iron and boron are known for use in the production of permanent magnets. With these permanent magnet alloys, to achieve coercive force values adequate for permanent magnet production, it is necessary to use special processing techniques. Specifically, it is necessary either to use powder metallurgy processing, wherein the alloy is comminuted to form particles which are then used to form a magnet by pressing and sintering, or melt spinning the molten alloy to form a rapidly solidified, thin ribbon, which may be comminuted to form particles for use in magnet production. Both of these practices are relatively expensive, compared to direct casting of molten alloy to produce magnets. In addition, during the comminuting operation to reduce the alloy to fine particle form, a loss in coercivity results. This coercivity loss is unrecoverable.

SUMMARY OF THE INVENTION

It is accordingly a primary object of the present invention to produce rare earth magnet alloys suitable for use in the production of permanent magnets, wherein the magnets may be made by simple casting of the molten alloy, and thus resorting to melt spinning and powder metallurgy processing is unnecessary.

Another object of the invention is to provide a permanent magnet alloy that may be used to produce bonded permanent magnets wherein during the comminuting operation incident to producing the fine particles required for bonding, significant loss of coercive force is avoided.

The alloy of the invention has at least one light rare earth element, iron and carbon. The alloy has a cellular microstructure of at least two solid phases with a $Fe_{14}R_2C_1$ magnetically hard tetragonal major phase and at least one minor phase. The light rare earth element (R) may be praseodymium and neodymium singly or in combination. The alloy is in the form of a casting solidified from the alloy in molten form. The casting may be in the form of a cast permanent magnet. Optionally, the alloy may be comminuted for use in forming a bonded permanent magnet comprising the alloy in particle form in a bonding matrix.

In addition to a light rare earth element, iron and carbon, boron may be also be added to the composition. In addition, at least one heavy rare earth element (HR) may be used in combination with at least one light rare earth element. The heavy rare earth element may be dysprosium.

With the alloy having a light rare earth element, iron and carbon, at least two solid phases are formed, including a magnetically hard tetragonal major phase of $Fe_{14}R_2C_1$ and at least one minor phase contained within it as a cellular structure. If boron is added, the major phase is $Fe_{14}R_2(C,B)_1$. If a heavy rare earth element is used, the major phase is $Fe_{14}(R,HR)_2C_1$. If boron is used in combination with at least one light rare earth element and heavy rare earth element, the major phase is $Fe_{14}(R,HR)_2(C,B)_1$.

In producing the permanent magnet alloy in accordance with the method of the invention, a precursor alloy for any of the aforementioned compositions in accordance with the invention is cast to form a cast body of the precursor alloy. The precursor alloy has a $Fe_{17}R_2$ primary phase with the alloying addition of carbon and optionally additional rare earth elements, including a heavy rare earth element, and boron. The cast body is heated for a time at temperature to transform the precursor phases, one of which is $Fe_{17}R_2$, to one of the aforementioned magnetically hard, tetragonal major phases in accordance with the invention. The major phase and at least one minor phase form to create a cellular microstructure. In the formation of bonded magnets the cast body, after heating is comminuted to form the required particles. The particles are incorporated in a bonding matrix to form the bonded permanent magnet. Preferably, heating is conducted at a temperature of at least 700° C.

DESCRIPTION OF THE PREFERRED EMBODIMENTS

Reference will now be made in detail to the present preferred embodiments of the invention.

Experimental alloys were prepared by arc melting in a high-purity argon atmosphere using elemental iron, neodymium and dysprosium of 99.9 mass % purity and graphite of a purity of 99.94%. To develop the tetragonal phase, the specimens were annealed in evacuated and sealed glass capsules. The specimens were examined by standard metallographic techniques and X-ray diffraction analysis. The magnetic properties were measured with a vibrating sample magnetometer or a permeameter, with a maximum field of 15 and 30 kOe, respectively.

A specimen of the composition $Fe_{77}Dy_{15}C_8$ was solidified after casting. The $Fe_{17}Dy_2$ was the primary phase. In the as-cast condition, the alloy had negligible coercivity. After annealing at 900° C. for 72 hours, the formation of a large fraction of $Fe_{14}Dy_2C_1$ resulted with the alloy having a coercive force of 12.5 kOe when the specimen was magnetized to a maximum field of 23 kOe. The measured remanence of the specimen was 2 kOe.

Crushing of the material to a particle size less than 38 microns resulted in no loss of coercive force when the particles were aligned in a magnetic field and bonded in paraffin.

It was determined that the remanence of the alloys in accordance with the invention may be increased by replacing a portion of some of the dysprosium with neodymium. In addition, boron was added. With the resulting precursor alloy of $Fe_{77}Nd_9Dy_6C_{7.2}B_{0.8}$, the remanence was improved while retaining coercive force during heating at 900° C. The magnetic property data for this alloy are $B_r=3$ kG; $H_{ci}=11.5$ kOe; Tc $=270°$ C.

During metallographic examination of these experimental alloys, the material in the as-cast condition was characterized by a primary phase of $Fe_{17}R_2$. After annealing, most of the primary phase was converted to a magnetically hard tetragonal $Fe_{14}(Nd,Dy)_2(C,B)_1$ phase. A minor phase and the magnetically hard, tetragonal major phase was observed to form a cellular structure.

As may be seen from the above-reported examples, the tetragonal carbide phase is capable of yielding high coercivity values in the as-cast state, without the need for special processing as is the case with conventional prior-art rare earth element, permanent magnet alloys. In addition, comminution of the casting to form fine particles, as for purposes of producing bonded magnets, does not result in degradation of coercivity.

What is claimed is:

1. A method of producing a permanent magnet alloy having a cellular microstructure from a precursor alloy consisting essentially of at least one light rare earth element (R), iron and carbon and having a precursor $Fe_{17}R_2$ solid phase, said method comprising casting said precursor alloy to form a cast body of said precursor alloy, heating said cast body for a time at temperature to transform said precursor phase to a $Fe_{14}R_2C_1$ magnetically hard, tetragonal major phase and at least one minor phase.

2. The method of claim 1 wherein R is a rare earth element selected from the group consisting of Nd and Pr.

3. The method of claim 1 wherein said cast body after heating is comminuted to form particles.

4. The method of claim 3 wherein said particles are incorporated into a bonding matrix to form a bonded permanent magnet.

5. The method of claim 1 wherein said heating is at a temperature of at least 700° C.

6. A method of producing a permanent magnet alloy having a cellular microstructure from a precursor alloy consisting essentially of at least one light rare earth element (R), iron, carbon and boron and having a precursor $Fe_{17}R_2$ solid phase, said method comprising casting said precursor alloy to form a cast body of said precursor alloy, heating said cast body for a time at temperature to transform said precursor phase to a $Fe_{14}R_2(C,B)_1$ magnetically hard, tetragonal major phase and at least one minor phase.

7. The method of claim 6 wherein R is a rare earth element selected from the group consisting of Nd and Pr.

8. The method of claim 6 wherein said cast body after said heating is comminuted to form particles.

9. The method of claim 8 wherein said particles are incorporated into a bonding matrix to form a bonded permanent magnet.

10. The method of claim 6 wherein said heating is at a temperature of at least 700° C.

11. The method of producing a permanent magnet alloy having a cellular microstructure from a precursor alloy consisting essentially of at least one light rare earth element (R), at least one heavy rare earth element (HR), iron and carbon and having a precursor $Fe_{17}R_2$ solid phase, said method comprising casting said precursor alloy to form a cast body of said precursor alloy, heating said cast body for a time at temperature to transform said precursor phase to a $Fe_{14}(R,HR)_2C_1$ magnetically hard, tetragonal major phase and at least one minor phase.

12. The method of claim 11 wherein R is a light rare earth element selected from the group consisting of Nd and Pr and HR is Dy.

13. The method of claim 11 wherein said cast body after said heating is comminuted to form particles.

14. The method of claim 13 wherein said particles are incorporated into a bonding matrix to form a bonded permanent magnet.

15. The method of claim 11 wherein said heating is at a temperature of at least 700° C.

16. A method of producing a permanent magnet alloy having a cellular microstructure from a precursor alloy consisting essentially of at least one light rate earth element (R), at least one heavy rare earth element (HR), iron, carbon and boron and having a precursor $Fe_{17}R_2$ solid phase, said method comprising casting said precursor alloy to form a cast body of said precursor alloy, heating said cast body for a time at temperature to transform said precursor phase to a $Fe_{14}(R,HR)_2(C,B)_1$, magnetically hard, tetragonal major phase and at least one minor phase.

17. The method of claim 16 wherein R is a light rare earth element selected from the group consisting of Nd and Pr and HR is Dy.

18. The method of claim 16 wherein said cast body after said heating is comminuted to form particles.

19. The method of claim 18 wherein said particles are incorporated into a bonding matrix to form a bonded permanent magnet.

20. The method of claim 16 wherein said heating is at a temperature of at least 700° C.

* * * * *